United States Patent [19]

Pfleger et al.

[11] 4,007,680

[45] Feb. 15, 1977

[54] GRAVURE PRINTING CYLINDERS

[76] Inventors: Frank G. Pfleger, 2 Oak Place, Waldwick, N.J. 07463; Howard Howland, 88 Clinton Place, Hackensack, N.J. 07601

[22] Filed: July 3, 1974

[21] Appl. No.: 485,551

[52] U.S. Cl. ..... 101/153; 29/132; 101/328; 101/401.1

[51] Int. Cl.[2] ..... B41F 9/00

[58] Field of Search ..... 117/94, 132 BE, 161 ZB; 101/150, 170, 348, 368, 153, 401.1, 395, 375, 462, 328; 29/130, 132

[56] References Cited

UNITED STATES PATENTS

| | | | |
|---|---|---|---|
| 2,338,558 | 1/1944 | Wickwire, Jr. | 101/170 |
| 2,638,050 | 5/1953 | King | 101/170 X |
| 2,918,867 | 12/1959 | Killary et al. | 101/375 |
| 2,987,994 | 6/1961 | Allison | 101/375 X |
| 3,232,231 | 2/1966 | De Maria et al. | 101/395 |
| 3,309,224 | 3/1967 | Weber | 101/462 X |
| 3,322,537 | 5/1967 | Giaimo, Jr. | 101/150 X |
| 3,338,163 | 8/1967 | De Maria et al. | 101/395 X |
| 3,666,479 | 5/1972 | Wiese | 101/395 X |
| 3,687,072 | 8/1972 | Pym | 101/150 X |
| 3,737,963 | 6/1973 | Postulka et al. | 29/132 X |
| 3,739,722 | 6/1973 | Zottoli | 101/375 |
| 3,850,664 | 11/1974 | Siegmund, Jr. | 117/132 BE |

OTHER PUBLICATIONS

Condensed Chemical Dictionary 6th ed. pp. 444–445 "Epon resins."

*Primary Examiner*—Clifford D. Crowder
*Assistant Examiner*—R. E. Suter
*Attorney, Agent, or Firm*—John J. Hart

[57] ABSTRACT

The printing surface of the cylinder is constituted of an Epon resin on which has been mechanically provided the desired images to be printed. The printing cylinder is preferably a hollow cylinder having a cylindrical body formed of a layer of a wound fabric impregnated with a phenolic resin. The hollow cylinder and the shaft and end flanges of the cylinder are constructed to provide a sturdy printing cylinder, into the hollow interior of the body of which, the inks used in printing cannot seep.

5 Claims, 7 Drawing Figures

GRAVURE PRINTING CYLINDERS

THE INVENTION

This invention relates to printing cylinders and has for its principal purpose the provision of an improved image bearing surface on printing cylinders.

The invention is primarily concerned with gravure printing using water based colors. This type of printing is usually practiced with printing cylinders provided with copper surfaces on which the images are formed by treating such surfaces with acids. Cylinders of this type are quite expensive to make due principally to labor costs and the care which must be exercised in their manufacture. This is especially true of those steel or aluminum based printing cylinders which are copper and chrome plated.

There are also certain problems inherent with the use of metal printing cylinders in gravure printing. Thus in the use of water based colors by such cylinders there is a tendency of the pigments used in such colors to cake up in the depressions forming the engravings on such printing cylinders. This problem is so serious that it materially effects the quality of the printing in relatively short periods of time and also restricts the range of printing color tones that can be printed with metal cylinders. It has been found by experience that this caking of the pigment in the engraved depressions has practically eliminated the possibility of printing light color tones in the range of tones below 20% due to the rapidity of the build up of the pigment in the relatively shallow engraved depressions required to be used in printing such light color tones. Another problem in the use of metal printing cylinders is caused by the abrasive action that the inks exercise on the metal cylinder surface. This abrasive action of such inks is so substantial that after four hundred hours of use the quality of printing produced by most metal surfaced printing cylinders will have materially deteriorated under the resulting wear. A further dissatisfaction that has been encountered in the use of metal surfaced printing cylinders is the tendency of the inks deposited thereon to foam and bubble during the rotation of such cylinders. The reason for this phenomenon is not clear but it is quite prevalent in the use of metal surfaced printing cylinders.

The principal object of the present invention is to provide a printing cylinder gravure surface which does not have the structural drawbacks of the usual copper and chrome plated printing cylinder gravure surfaces and which can be provided with the required images without the use of acids.

Another object of the invention is to provide an improved homogenous printing surface that can be produced inexpensively and may be machine engraved to provide clear images.

A further object of the invention is to provide an improved printing cylinder gravure surface that will overcome the inherent disadvantages of the metal surfaced gravure printing cylinders.

In accordance with the invention, the aforesaid objects are attained by providing a printing cylinder surface constituted of epoxy materials which are light in weight, can be satisfactorily cut by any known type of mechanical or electronic engraving mechanism to form clear images thereon, and which have good wearability.

Other objects, as well as the advantages of the invention, will appear from a perusal of the following description when read in connection with the accompanying drawings, in which.

Figure 1:
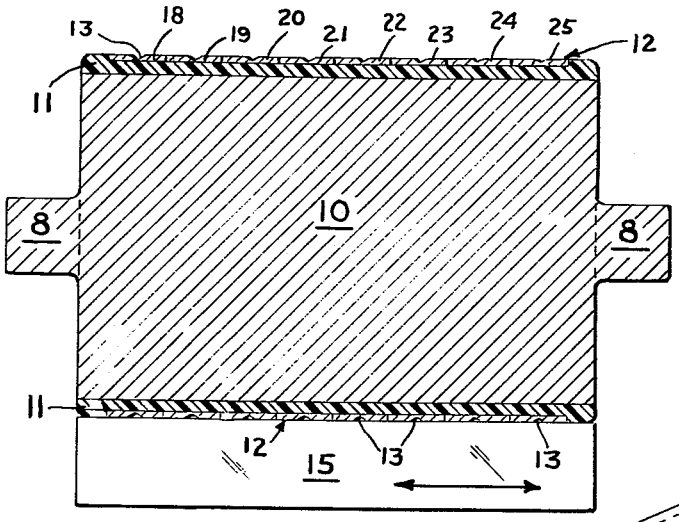
FIG. 1 is a vertical sectional view of a customary aluminum or steel based cylinder provided with an epoxy resin coating in accordance with the invention.

In FIG. 1 of the drawings, the reference numeral 10 indicates generally an aluminum or steel printing cylinder of the type usually employed in the industry in gravure printing using water based colors. Instead of the usual copper and chrome plating provided on such cylinders in accordance with present practice, the cylinder 10 is provided with a coating 11 of an epoxy resin, such as the condensation products of epichlorohydrin and bisphenol-A known as "Epon" resins, and an example of which is the low molecular weight resin known as "Epon" No. 828 manufactured by the Shell Chemical Company of Texas. The chemical structure of a typical molecule of Epon 828 is as follows:

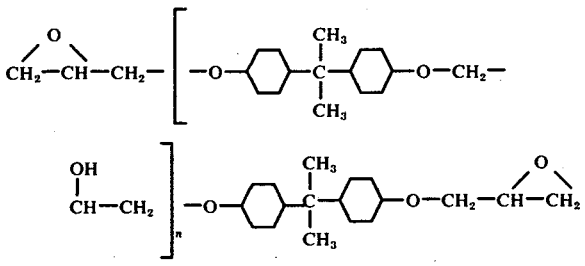

The specifications of the Epon 828 sold by Shell Chemical Company are as follows:

| | |
|---|---|
| Color, 25° C. (Gardner) | 4 max. |
| Kinematic Viscosity, 25° C. | 100–160 poises |
| Epoxide Equivalent | 185–192 |
| TYPICAL PROPERTIES OF EPON 828 | |
| Weight per Gallon, lbs., 20° C. | 9.7 |
| Density, g./ml., 20° C. | 1.168 |
| Refractive Index, 25° C. | 1.570–1.575 |
| Flash Point, Tag Open Cup, ° F. | >175 |
| Hydroxyl Content, equiv. OH/100 g. resin | 0.06 |
| Avg. Molecular Weight (approx.) | 380 |
| Equivalent Weight (g. resin to esterify one mole of acid) | 85— |

An epoxy resin of the above indicated type adheres very well to steel, aluminum and phenolic surfaces.

When prepared for coating to the peripheral surface of a steel, aluminum of phenolic resin cylinder at ordinary temperatures of about 70° F. the epoxy resin of the type indicated has a thick viscosity approximating the viscosity of molasses at a cool temperature, say of the order of 60° F. When the epoxy resin coating has set or hardened, its texture is such that it may be machined and polished without danger of chipping and will provide a smooth continuous surface when so treated.

In preparing the "Epon" resin 828 for application to the cylinder 10, it is mixed with an "Epon" curing or hardening agent known as No. V-40 also made by the Shell Chemical Company. This curing agent is a viscous polyamide resin derived from a dimerized fatty acid and an aliphatic polyamine and has the following specifications:

| | |
|---|---|
| Amine Value | 350–400 |
| Viscosity, 75° C | 2–6 poises |
| Color, Gardner | 12 Max. and |

the following properties:

| | |
|---|---|
| Specific Gravity, 25° C | 0.97 |
| Weight/Gallon, 25° C | 8.1 pounds |
| Flash Point, ASTM D-92 | 185° C |

The resin and the curing agent are mixed undilutedly in the proportion of 60% by volume of resin to 40% by volume of curing agent. The mixing of these two ingredients is done very carefully so that there are no air bubbles developed in the mixture. This undiluted mixture is then carefully applied to the exterior surface of the cylinder to be coated by means of a brush while rotating the cylinder 10 at approximately one revolution every 5 seconds. In applying the epoxy resin to the cylinder 10, disc-shaped forming members 9,9 are first secured on the shafts 8,8 thereof so that they abut the ends of the body of the cylinder. The forming members 9,9 have an exterior diameter equal to the sum of the diameter of the body of the cylinder 10 and the thickness of the coating of epoxy resin that is to be applied to the cylinder 10. Thus, the peripheral edges of the forming members 9,9 will project beyond the periphery of the cylinder 10 by a distance equal to the thickness of the applied epoxy coating. As stated, the epoxy resin is applied to the periphery by a brush 7 which is reciprocated back and forth in the manner indicated by the arrows in FIG. 2 to spread the resin evenly on the cylinder 10 between the two forming members 9,9. When the level of the applied resin becomes flush with the peripheries of the forming members 9,9 the application of the epoxy resin is stopped. Preferably, sufficient of the resin mixture is so applied as to provide a uniform layer or coating 11 of approximately ⅛ inch thickness. When the desired thickness of layer 11 has been attained, the cylinder 10 is kept revolving for an additional four hours, or until the mixture constituting such layer has reached its setting time. This additional rotation of the coated cylinder 10 is carried on while the cylinder is enclosed in a vacuum of at least twenty inches.

Figure 3:
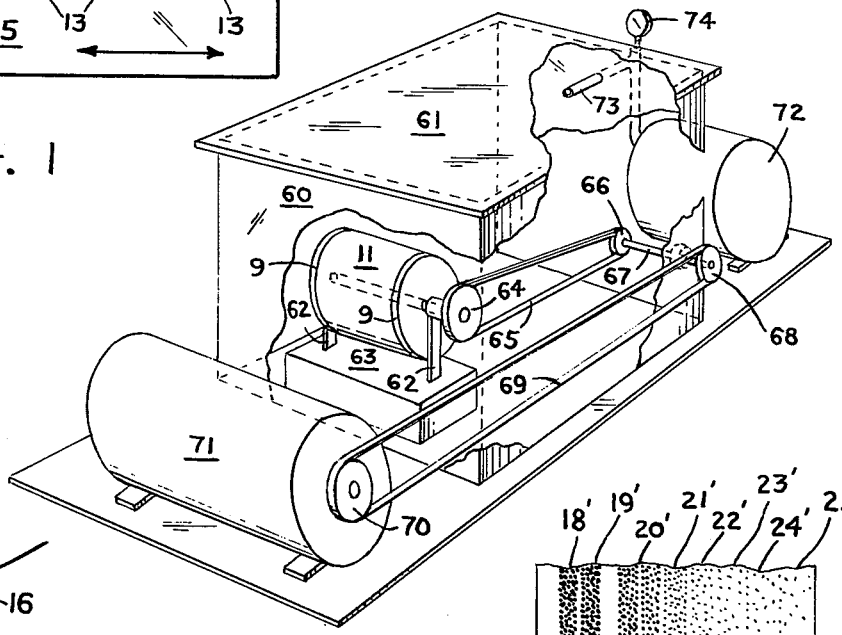
FIG. 3 is a perspective view of vacuum means for setting the applied epoxy resin coating; the vacuum housing being partly broken away and the broken away portion indicated in dotted outline, to show the construction of such vacuum means more clearly.

As is shown in FIG. 3 of the drawings, the vacuum means for setting the applied epoxy resin coating may comprise a suitably formed housing 60, provided with a removable top cover 61 that can be fitted in sealed relation on the top edges of the housing 60. Preferably, the cover 61 may be constituted of a transparent plate of plexiglass in order to enable observation of the epoxy coating as it is being hardened. The cylinder 10, with the forming members 9,9 still in position thereon is rotatably supported within the housing 60 on a pair of bearing standards 62,62 mounted on a suitable base 63. One of the cylinder shafts 8 is connected to a pulley 64 that is driven through a V-belt 65 by a pulley 66 located within the housing. The pulley 66 is secured to the inner end of a shaft 67 that extends through the wall of the housing and is rotatably supported by an air-tight gland bushing of known construction. The outer end of the shaft 67 is provided with a pulley 68 that is connected by a V-belt 69 to a pulley 70 secured to the shaft of an electric motor 71 constructed to rotate one revolution every five seconds. The pulleys are also so constructed that the drum 10 within the housing will revolve at a constant speed of the revolution every five seconds. Associated with the housing 60 is a vacuum pump 72 which is in communication with a pipe 73 that extends through a wall of the housing 60 and into the interior of such housing. Between the vacuum pump 72 and the pipe 73 is a vacuum gauge 74 of known construction and capable of maintaining a vacuum within the housing of 20 inches throughout the entire period required for a proper setting of the epoxy coating 11.

As a result of such rotation of the epoxy material under a vacuum of 20 inches throughout the entire setting time thereof, any air bubbles that may have been contained in the epoxy coating, will have been drawn or floated to the surface of such coating, thereby rendering the coating air bubble free. This treatment, it has been found, is important to the attainment of quality printing for long periods.

When the air bubble free mixture of layer 11 has properly set, the rotational movement of the cylinder is stopped and the forming members 9,9 removed therefrom, the cylnder is then set aside for curing. It has been found that a mixture of the example given will take a minimum of seven days or 168 hours of curing before it can be further processed. At the end of that time the layer 11 is machined by a cutting lathe of a known type to eliminate any irregularities and to bring the peripheral surface of layer 11 to the exact dimensions required for the printing operation. The surface of layer 11 is then given a smooth continuity by polishing and buffing in the customary fashion.

When the completed cylinder is to be employed in a gravure printing operation, the coating 11 need not be provided with the required image by the use of acids as is the usual practice, as the material thereof lends itself readily to the provision thereon of such image by machine engraving using known mechanical and electronic printing cylinder engraving mechanism. It has been found that epoxy material of the indicated type and prepared in the manner above described will cut well and provide clearly defined printing images that will maintain their clarity of form through prolonged printing operations. As indicated in FIG. 1, the image 12 produced by such means is constituted of a multiplicity of depressions 13, the depths of which depend on the densities of the tone shades to be printed. Thus, for light tones, the depressions 13 will be relatively shallow, while for dark tones, the depressions 13 will be correspondingly deeper.

Figure 4:
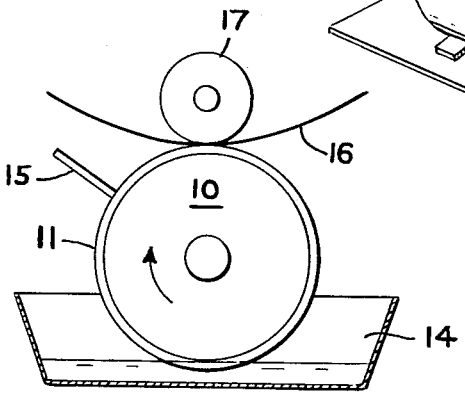
FIG. 4 is a schematic illustration showing the manner in which the printing cylinder of FIG. 1 is employed in gravure printing of a web.

The durability of a coating 11 made in accordance with the invention has been demonstrated by subjecting the surface of such a coating to a test run of over 600 hours which is comparable to the useful life of the usual copper and chrome plated printing cylinder. In making this test run, the usual gravure printing practice was followed, the printing cylinder 10 being mounted for rotation so that the coating 11 thereof was progressively submerged in a fountain 14 of a water based ink of given color, as is shown in FIG. 4 of the drawings. As the coating 11 emerges from the fountain 14 it is, in accordance with usual practice, scraped by a reciprocating doctor blade 15 to spread the ink evenly over the coating and to remove the surplusage thereof before the inked coating engages the surface of the web 16 to be printed at the bite between the printing cylinder 10 and the impression roller 17. In accordance with the invention the doctor blade 15 is made approximately 6 thousandths of an inch thick and of the plastic Mylar manufactured by DePont de Nemours & Co. It has been found that when the doctor blade is so constructed and employed in the water based inking of epoxy coated printing cylnders it will remain unworn and true for exceptionally long periods of time and will have a far longer effective life that the doctor blades presently employed in gravure operations. In the test run above described, only a minimal amount of wear on the doctor blade 15 could be ascertained even after 600 hours of usage.

Figure 5:
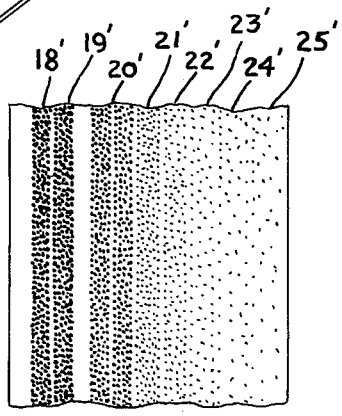
FIG. 5 is a piece of web on which has been printed test tone strips by the cylinder herein after the latter has been subjected to a prolonged period of operation.

The coating 11 was provided with an image 12 constituted of a series of annular printing bands 18–25. Each of the bands 18–25 is composed of depressions 13 having such size and proximity as to print a given continuous tone color and by varying the size and proximity of the depressions in the coating 11, as is indicated by the printed dots shown in FIG. 5 of the drawings, continuous bands of different color graduations may be produced on a web. Thus, the bands 18 and 19 were were formed of relatively deep depressions 13 to form strips 18' and 19' of darkly printed 100% tones, see FIG. 5. The depressions 13 in the band 20 are made slightly smaller in depth to produce a strip 20' of about 90% tone. Progressively smaller depressions 13 are provided in the bands 21 through 25 to produce strips 21' through 25', in FIG. 5, of progressively lighter tone. The tone of strip 22' has a value of 20% which is less than that possible of being produced by the metal and chrome plated gravure cylinders due to the propensity with which water based inks cake up in the depressions of such metal cylinder. Even lower in tone value than strip 22' is strip 23' of 15% tone, strip 24' of 10% tone and strip 25' of 5% tone. Thus, by use of the coating of this invention it is possible to extend the range of light tones to a 5% tone. It has also been found possible to extend the range above what has been considered solid with metal printing cylinders to a tone that may be considered 100%. The attainment of a tone range of from 5% to 100% with the epoxy resin printing cylinder of this invention enables the obtaining of images having better detail than is now possible with metal printing cylinders. It is believed that this result is attained because the epoxy resin has the quality of attracting water based inks to its surface when the inks are being applied thereto, and of repelling the inks upon contact of the epoxy resin surface with the web being printed, thereby eliminating any caking of the inks on the image depressions. As a consequence, it has been found possible to print tones of 20% or less without problem.

In conducting the aforesaid test run of the printing cylinder of this invention, the printing cylinder 10 was rotated continuously at 27 RPM. Sample printings were examined at 200 hours, 400 hours and 600 hours. The samples exhibited no wear whatsoever and the sample taken at 600 hours which corresponds to a printing of 972,000 impressions, was no different in quality of printing than that of the sample taken at 200 hours. So far as we are aware, copper and chrome plated gravure printing cylinders as presently constructed cannot match this durability in quality of the printing cylinder of this invention.

Figure 6:
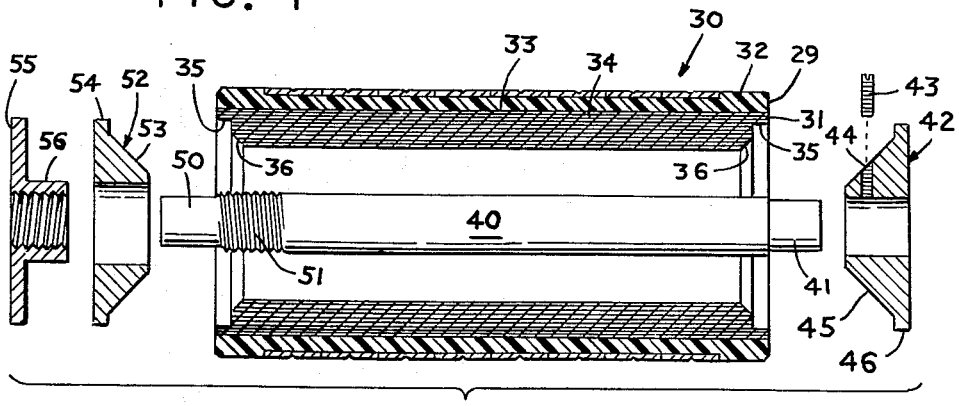
FIG. 6 is an exploded vertical sectional view of a preferred form of printing cylinder constructed in accordance with the invention.

Instead of providing the aforesaid printing epoxy surface on existing metallic printing cylinders in the manner hereinabove described, it is preferred that if the printing cylinder is less than 36 inches wide, it be constructed in the manner now to be explained. A preferred embodiment of the invention is shown in FIG. 6 of the drawings, wherein the reference numeral 30 generally designates a hollow printing cylinder having its cylindrical wall composed of an inner cylindrical layer 31 and an outer cylindrical layer 32. The inner layer 31 is formed of a wound sheet 33 of cloth or paper impregnated and embedded in a known phenolic plastic 34, such as the phenolics No. 2029 and No. 1841 manufactured and supplied by The General Electric Company.

Figure 2:
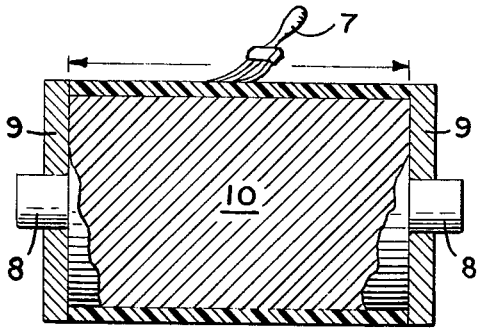
FIG. 2 is a vertical sectional view showing the manner in which the epoxy resin is applied to the metal cylinder of FIG. 1.
Figure 1A:
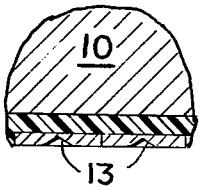
FIG. 1A is a partial, enlarged vertical sectional view of the coated cylinder shown in FIG. 1 of the drawings.

In constructing the inner layer 31, use may be made of a cylinder having secured to the shafts thereof, forming end discs in the manner of the forming discs 9,9 shown in FIG. 2 of the drawings and brushing the resin on in the manner previously described with respect to the epoxy resin. Preferably, however, elongated plastic and fabric tubes of this type are bought from a suitable source and cut to the widths of cylinders 31 desired. The General Electric Company manufactures phenolic tubes of this type and they are also readily available from several other sources. After an inner cylinder has been formed or cut from an elongated commercially produced tube, each of its ends is machined to provide an end resin having an outer annularly-shaped seat 35 and a beveled seat 36, the purpose of which will be hereinafter explained.

The outer layer 32 is constituted of a resin of the type used in constructing the layer 11 in FIG. 1 and is formed on the layer 31 in the manner described with respect to the formation of layer 11. The outer layer 32 is machine engraved for printing in the manner described with relation to layer 11.

Extending through the hollow printing cylinder 30 is a steel shaft 40 having a reduced end portion 41 which is received in the central opening of an annular steel flange 42. The flange 42 is secured to shaft 40 by a steel set screw 43 which is threadedly received in a threaded opening 44 provided in the flange 42 and engages at its inner end with the inserted reduced end portion 41 of the shaft. The flange 42 has a conically-shaped inner surface 45 which engages the beveled seat 36 in the adjacent end of the inner cylinder 31 and centers such flange and shaft 40 with respect to the cylinder 30. The flange 42 also has an outer circular rim 46 which seats in the annular seat 35 provided in the adjacent end of the inner cylinder layer 31. The rim 46 has a thickness, approximating the width of the annular seat 35 so that the outer face of the flange 42 is substantially flush with the adjacent terminal end of the inner cylinder 30.

The other end of the shaft 40 is provided with a reduced terminal portion 50 and adjacent to the latter a threaded portion 51. Loosely encircling the threaded portion 51 of shaft 40 is a flange 52 having a conically-shaped inner surface 53 engageable with the inclined seat 36 on the adjacent end of the inner cylinder layer 31 to center the flange and shaft 40 with respect to the cylinder 30. The flange 52, like the flange 42, is provided with an annular rim 54 which seats in the other annular recesed seat 35 in the adjacent end of the inner layer 31. When so seated the outer face of the flange 52 is substantially flush with the adjacent terminal end of the inner layer 31. The flange 52 is secured in seated position in the end of the inner layer 31 by a steel flanged lock member having a disc-shaped outer end 55 which seats on the outer face of the flange 52, and having a central inwardly projecting tubular portion 56 which extends through the central opening in flange 52 and is in threaded engagement with the screw thread 51 on shaft 40. When the flange 52 and the lock member are tightly secured in position with respect to the cylinder 30 and shaft 40, the reduced shaft end portion 50 projects beyond the lock member. In a similar fashion the end 41 will project beyond the assembled flange 42.

It is believed evident from the foregoing description of the preferred embodiment of the invention that is provides a light weight printing cylinder having a seamless printing surface on which the printing images have been formed by machine engraving and which possesses a wearability that has been found to be greater than that of presently constructed copper or chrome plated metal printing cylinders. As a result of the manner in which this hollow printing cylinder is constructed, when the parts are assembled the resulting printing cylinder is of adequate strength and sturdiness to perform its intended purposes without seepage of the inks employed during such usage into the interior of the cylinder.

What is claimed is:

1. A gravure printing cylinder particularly for use in a gravure printing press having an impression roller forming with said cylinder a printing bite through which advances the sheet to be printed, and including means for applying printing ink to the surface of the cylinder in advance of such bite, said cylinder comprising a cylindrical body portion having an outer printing layer of hardened resinous material consisting almost entirely of an undiluted mixture of an epoxy resin and an epoxy curing agent, said resinous material having an outer smooth printing surface of uniform diameter in which are provided a multiplicity of ink carrying depressions for producing given printed images and said resinous material being substantially bubble free and having the properties characteristic of a mixture of an unmodified bisphenol-A epoxy resin, such as "Epon No. 828" having the chemical structure

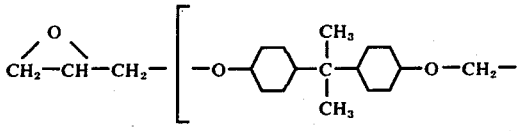

-continued

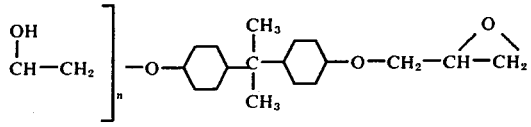

and a viscous polymide resin such as the "Epon Curing Agent V-40" derived from a dimerized fatty acid and an aliphatic polyamine, in that such mixture has a viscosity at about 70° enabling it to form said printing layer, has good adherence to aluminum, steel and phenolic body portions, and when set can be machined without chipping and then polished to a smooth finish, and that has a capability of maintaining clarity of images made with water based printing inks through prolonged printing operations exceeding 600 hours.

2. A gravure printing cylinder as defined in claim 1, in which said resinous material consists almost entirely of a mixture approximating 60% by volume of epoxy resin and 40% by volume of epoxy curing agent.

3. A gravure printing cylinder as defined in claim 1, in which said body portion comprises an inner tube integral with said outer printing layer and made of resinated material having characteristics different from those of the resinous material of said outer printing layer, said inner tube having a thickness greater than that of said outer printing layer and having a length approximating that of said outer printing layer, the terminal ends of said inner tube each having formed therein an internal annular seat providing an internal annular shoulder spaced inwardly from such terminal end and having formed therein a beveled seat portion extending inwardly from the inner periphery of said annular shoulder.

4. A gravure printing cylinder as defined in claim 3, including a shaft extending through said body portion and having an exterior diameter substantially less than the interior diameter of said inner tube to form an annular chamber between said shaft and body portion, and means for securing said body portion to said shaft and providing a fluid tight seal at the ends of said annular chamber, said securing means including a pair of rigid end flanges each having an outer peripheral circular portion seated in an internal annular seat at a terminal end of said inner tube and engaging the annular shoulder formed by such seat and having an inner conically-shaped portion seated in the associated beveled seat portion at such inner tube end, first means for securing one of said flanges to one end of said shaft, and second means for simultaneously securing the other of said flanges to the other end of said shaft, and both of said flanges in seated relation to the terminal ends of said inner tube.

5. A gravure printing cylinder as defined in claim 4, in which said one end of said shaft is reduced to provide a shoulder spaced from the terminus of said one shaft end, said one flange being seated on said reduced shaft end and against said shaft shoulder, and in which the other end of said shaft has a threaded portion encircled by said other flange, said second securing means including said threaded shaft portion and a lock member having an outer portion engageable with the outer surface of said other flange, and an inwardly projecting threaded portion extending through and forming a seat for said other flange and being in threaded engagement with said threaded shaft portion.

* * * * *